US006072112A

United States Patent [19]

Suenaga et al.

[11] Patent Number: 6,072,112

[45] **Date of Patent: *Jun. 6, 2000**

[54] ELECTRONIC PERCUSSION INSTRUMENT

[75] Inventors: Yuichiro Suenaga; Minoru Harada, both of Hamamatsu, Japan

[73] Assignee: Yamaha Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/010,229

[22] Filed: Jan. 21, 1998

[30] Foreign Application Priority Data

Jan. 24, 1997 [JP] Japan ..... 9-011336

[51] Int. Cl.[7] ..... G10D 13/02

[52] U.S. Cl. ..... 84/422.3; D13/158

[58] Field of Search ..... 84/422.3; D13/158

[56] References Cited

U.S. PATENT DOCUMENTS

| | | | |
|---|---|---|---|
| D. 215,602 | 10/1969 | Wolf | D13/158 |
| 3,973,099 | 8/1976 | Morris, Sr. | 200/511 |
| 4,079,651 | 3/1978 | Matsui . | |
| 4,297,542 | 10/1981 | Shumway | 200/6 A |
| 4,852,443 | 8/1989 | Duncan et al. . | |
| 5,056,403 | 10/1991 | Yamashita . | |

FOREIGN PATENT DOCUMENTS

| | | |
|---|---|---|
| 4-3358 | 2/1992 | Japan . |
| 2170639 | 8/1986 | United Kingdom . |
| 2173031 | 10/1986 | United Kingdom . |

*Primary Examiner*—Robert E. Nappi
*Assistant Examiner*—Shih-yung Hsieh
*Attorney, Agent, or Firm*—Ostrolenk, Faber, Gerb & Soffen, LLP

[57] ABSTRACT

An electronic percussion instrument has a covering section 7A for covering the rim switch 5 on the outer periphery of a pad member 7 and a switch compression section 13 and two grooves 14 are provided on the back surface of the covering section 7A. In the switch compression section 13, a pressing surface 13*a* is made into a curved surface protruding towards the rim switch 5. The result is that striking forces for pressing the rim switch 5 are concentrated on the switch compression section 13 so as to enable to reliably and effectively transmit the forces to the rim switch 5 by elastic deformation of the switch compression section 13, regardless of the hitting direction of the drumstick on the rim section.

4 Claims, 2 Drawing Sheets

ELECTRONIC PERCUSSION INSTRUMENT

BACKGROUND OF THE INVENTION

1. Field of the Invention

The present invention relates to an electronic percussion instrument such as electronic drum and electronic cymbal.

2. Description of the Related Art

Electronic cymbal sounds are generates by striking the instrument with a drumstick and converting the resulting vibrations produced in the instrument body to electrical signals and outputting the sounds through a speaker or headphone, as disclosed in a Japanese Practical Utility Model H4-3358, for example.

The performance capabilities demanded of such electronic cymbal instruments include: (1) response characteristics should be uniform regardless of the strike point; (2) vibrations generated by the strike should diminish smoothly without exhibiting the so-called "violent decay" phenomenon; (3) the impact sound generated by the drumstick should be low. For such reasons, cymbals are mostly made of a plastic plates of about 5 mm thickness molded into a flat plate or, as in non-electronic cymbal instruments, into a convex front surface. Also, to lower the impact sound, a padding made of such materials as rubber is attached to the strike region of the instrument, and, sensors such as piezoelectric elements are attached to the back side of the cymbal to convert the mechanical vibrations to electrical signals.

To enable performing rim shot playing (normal playing) and cup playing as do non-electronic cymbal instruments, the electronic cymbals are provided with a rim section and a pad section such that normal playing sounds are produced by striking the rim section while cup sounds are produced by rapping the pad section.

FIGS. 2–4 show various view of a conventional electronic cymbal instrument where FIG. 2 is a plan view, FIG. 3 is an enlarged cross sectional view of essential parts, and FIG. 4 is a cross sectional view of a rim switch. This cymbal instrument 1 is comprised by a dish-shaped instrument body 2 having an upward opening, a membrane 3 covering the upper opening section of the instrument body 2, a transducer 4 to convert the vibrations generated in the pad section A to electrical signals and a rim switch 5 to generate normal sounds when the rim section B is stricken.

The membrane 3 is comprised by a circular vibrational strip 6 (made of a metal, wood or plastic resin) and a pad 7 (made of a such flexible material as butyl rubber) for covering the front surface of the vibrational strip 6 and the rim switch 5. The central region of the instrument constitutes the pad section A and the outer peripheral region constitutes the rim section B. The transducer 4 is attached to the back surface of the vibrational strip 6.

As shown in a detailed view in FIG. 4, the rim switch 5 is comprised by two proximally disposed opposing flexible sheets 8A, 8B, a spacer 9 disposed between the sheets 8A, 8B, and a set of contacts consisting of a fixed point 10 and a movable point 11 respectively disposed on the opposing sheets 8A, 8B. The rim switch 5 is firmly attached to the front surface of the membrane attachment section 12 provided throughout the outer periphery of the instrument body 2, and is covered over by the outer periphery of the pad 7.

Pad 7 is a circular shaped member having a diameter larger than that of the vibrational strip 6, and its outer periphery constitutes the covering section 7A for folding over the rim switch 5. The front surface of the covering section 7A, which is formed into a convex front surface, clearly divides the pad section A from the rim section B. On the back surface side of the covering section 7A, there are provided a switch compression section 13 comprised by a ring-shaped protrusion and two ringshaped grooves 14. The pressing surface 13*a* of the switch compression section 13 for pressing onto the rim switch 5 is shaped flat.

A fold-back section 16 folding over to the back surface of the instrument extends integrally all around the outer periphery of the covering section 7A, thereby forming a ring-shaped groove 17 between the fold-back section 16 and the covering section 7A. The groove 17 is coupled to the membrane attachment section 12 and is firmly fixed thereto with an adhesive.

The electronic cymbal instrument 1 having the construction presented above is normally played by rapping the pad section A with a drumstick, and when it is desired to switch the playing mode, the rim section B is hit. When the rim section B is hit, the covering section 7A of the pad 7 undergoes elastic deformation, and the switch compression section 13 presses down on the upper sheet 8B, which causes the movable point 11 to touch the fixed point 10 to activate the rim switch 5 to produce rim shot sounds.

In such a conventional electronic cymbal instrument 1, the switch compression section 13 (for pressing on the rim switch 5) is provided on the back surface of the covering section 7A which covers over the rim switch 5 so that the magnitude of a stroke necessary to activate the rim switch 5 corresponds to the amount of elastic deformation produced by the switch compression section 13 in respond to the striking action of the drumstick. However, a problem with such a design is that, because the pressing surface 13*a* of the switch compression section 13 is flat, it is sometimes difficult to activate the rim switch 5 depending on the striking direction of the drumstick.

In other words, a vertical hit will produce a sufficient stroke in the switch compression section 13 to activate the rim switch 5, but any hit from a slant or horizontal direction may not produced sufficient stroke because of a dispersion of the striking force resulting that the rim switch 5 cannot be activated.

SUMMARY OF THE INVENTION

It is an object of the present invention to provide an electronic percussion instrument which is able to generate sounds regardless of the striking direction of the drumstick so as to reliably activate the rim switch.

The object has been achieved in an electronic percussion instrument comprising: a instrument body; a pad member covering a front surface of a strike section of the instrument body; a transducer for converting vibrations of the instrument body into electrical signals; and a rim switch disposed between the instrument body and the pad member for switching a playing mode; wherein a pressing surface of the pad member for pressing down onto the rim switch is formed into a curve shape to protrude towards the rim switch.

Application possibilities may include a case of a cymbal instrument representing the instrument body.

In these applications, a switch compression section may include the pressing surface, which is provided on a back surface of the covering section of the pad member for pressing down onto the rim switch, is comprised by an inner and an outer grooves formed in a circumferential direction on each radial side of the switch compression section in such a way to enhance performance.

In a percussion instrument having a switch arrangement of the present invention, the switch compression section of the pad member is associated with a pressing surface of a curved shape protruding towards the rim switch. The result is that regardless of the striking direction on the rim section, the force directed to the switch compression section is not dispersed over a wide area so that elastic deformation forces can be transmitted reliably to the rim switch. The grooves are shaped in such a way to enable the switch compression section to be clearly defined and to facilitate the switch compression section to respond to the impressed elastic deformation.

DESCRIPTION OF THE PREFERRED EMBODIMENT

Figure 1:
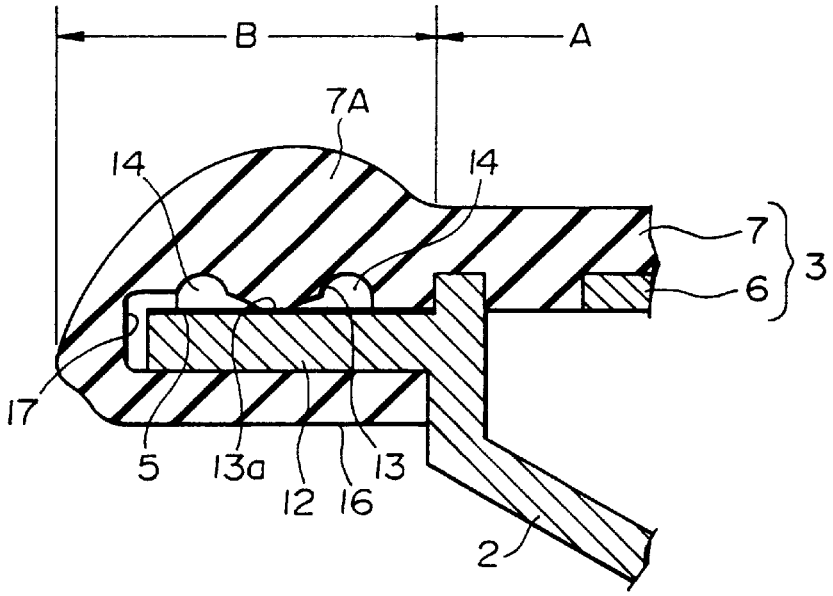
FIG. 1 is a cross sectional view of an application of the present invention to an electronic cymbal instrument.
Figure 2:
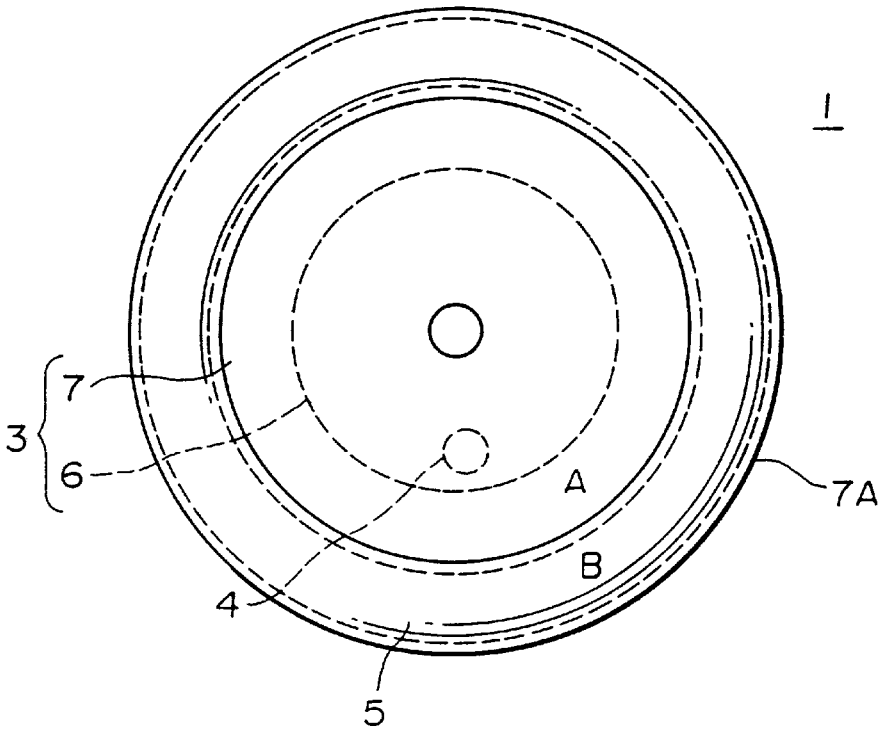
FIG.2 PRIOR ART
FIG. 2 is a plan view of a conventional electronic cymbal instrument.
Figure 3:
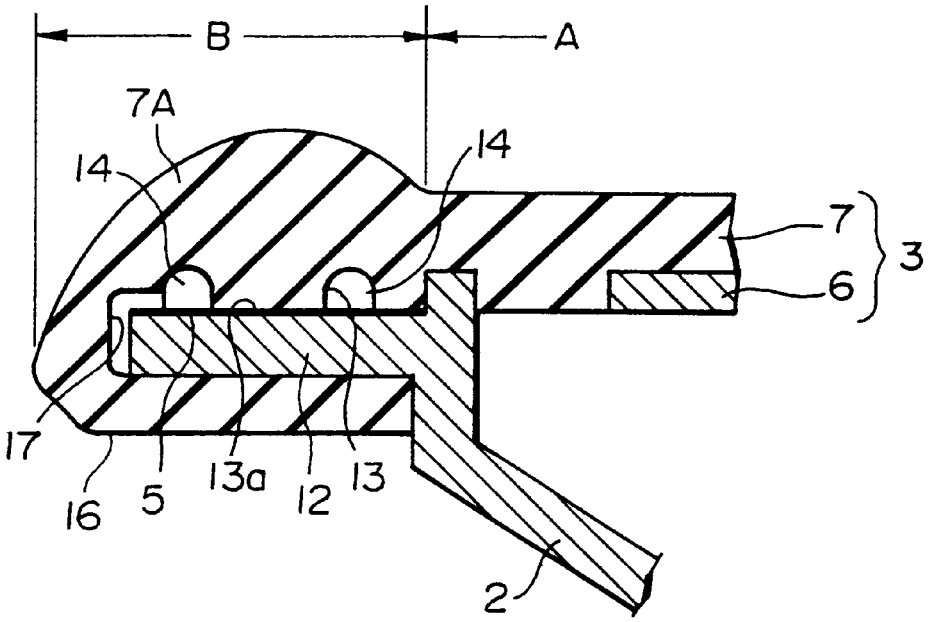
FIG.3 PRIOR ART
FIG. 3 is an enlarged cross sectional view of the essential parts of the conventional cymbal instrument.

In the following, the percussion instrument of the present invention will be presented with reference to the drawings. In the presentation, those parts which are the same as the conventional instrument are referred to by the same reference numerals, and their explanations will be omitted.

FIG. 1 shows an application of the invention to an electronic cymbal instrument. The membrane 3 forming the front surface of the (electronic) cymbal instrument is comprised by a vibrational strip 6 and a pad 7 (comprised of a flexible material such as butyl rubber) covering the front surface of the vibrational strip 6. The outer periphery of the pad 7 constitutes the covering section 7A to cover over the rim switch 5, and the switch compression section 13 is provided on the back surface of the covering section 7A to protrude integrally with the covering section 7A, for pressing down on the rim switch 5. The switch compression section 13 is formed into a protrusion by the ring-shaped inner and outer grooves 14, and the pressing surface 13*a* is formed in a curve shape to protrude towards the rim switch 5. Other structural features are the same as those in the conventional electronic percussion instruments.

Figure 4:
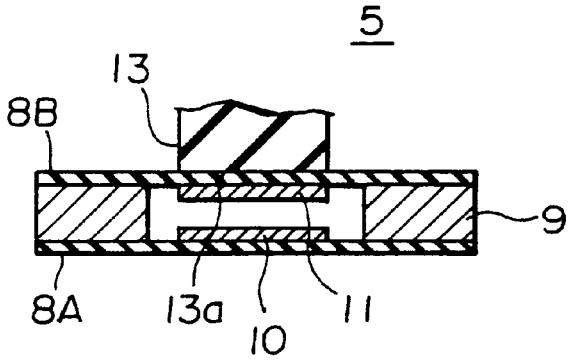
FIG.4 PRIOR ART
FIG. 4 is a detailed cross sectional view of a rim switch used in the conventional electronic cymbal instrument.

The cymbal instrument having the construction presented above performs normal playing by rapping the pad section A of the membrane 3 with a drumstick, and rim playing by hitting the covering section 7A of the pad 7 to activate the rim switch 5. When the covering section 7A is hit, the switch compression section 13 is deformed so that the pressing surface 13*a* presses on the rim switch 5 to press the movable point 11 (refer to FIG. 4) to the fixed point 10, thereby activating the rim switch 5.

In the present invention, the pressing surface 13*a* of the switch compression section 13 is shaped into a protruding curved surface so that the contact area is smaller compared with a flat pressing surface of the conventional switch. Therefore, pressing forces can be directed such that a sufficient stroke can always be generated to close the rim switch 5, even when the covering section 7A is hit from a non-vertical or horizontal direction. The result is that, regardless of the striking direction of the drumstick, the switch compression section 13 is reliably deformed elastically to press on the rim switch 5 to assure its activation. Also, because the switch compression section 13 is shaped into a protrusion extending in a circumferential direction by two inner and outer grooves 14 having a carefully merging wall configuration, the performance of the rim switch 5 is made even more effective than that of a switch of the conventional design by enabling to produce quick elastic deformation and sensitive response characteristics.

Although the present invention was illustrated by applying it to an electronic cymbal instrument, it is obvious that the invention is equally applicable to other percussion instruments such as an electronic drum instrument.

What is claimed is:

1. An electronic percussion instrument comprising: an instrument body; a pad member covering a front surface of a strike section of said instrument body; a transducer for converting vibrations of said instrument body into electrical signals; and a rim switch disposed between said instrument body and said pad member for switching a playing mode; wherein a pressing surface of said pad member for pressing down onto said rim switch is shaped into a protruding curved surface towards said rim switch, the shaping being such that said rim switch is activated regardless of the striking direction toward said pad member.

2. An electronic percussion instrument according to claim 1, wherein a switch compression section including said pressing surface, which is provided on a back surface of said covering section of said pad member for pressing down onto said rim switch, is comprised by an inner and an outer grooves formed in a circumferential direction on each radial side of said switch compression section in such a way to enhance performance.

3. An electronic percussion instrument according to claim 1, wherein said instrument body is a cymbal instrument.

4. An electronic percussion instrument according to claim 3, wherein a switch compression section including said pressing surface, which is provided on a back surface of said covering section of said pad member for pressing down onto said rim switch, is comprised by an inner and an outer grooves formed in a circumferential direction on each radial side of said switch compression section in such a way to enhance performance.

* * * * *